US007410407B2

(12) United States Patent
Krammel

(10) Patent No.: US 7,410,407 B2
(45) Date of Patent: Aug. 12, 2008

(54) METHOD AND APPARATUS FOR ENHANCING A BUSTLINE

(76) Inventor: Mandy Krammel, 8596 Wendy La. East, West Palm Beach, FL (US) 33411

( * ) Notice: Subject to any disclaimer, the term of this patent is extended or adjusted under 35 U.S.C. 154(b) by 164 days.

(21) Appl. No.: 11/367,062

(22) Filed: Mar. 3, 2006

(65) Prior Publication Data

US 2006/0264152 A1 Nov. 23, 2006

Related U.S. Application Data

(63) Continuation-in-part of application No. 11/130,512, filed on May 17, 2005, now abandoned.

(51) Int. Cl.
*A41C 3/00* (2006.01)

(52) U.S. Cl. ..... 450/58; 450/88; 450/86

(58) Field of Classification Search ..... 450/1, 450/88, 86, 58; 2/336, 327; 24/563, 305 R, 24/3, 12, 341, 372, DIG. 43
See application file for complete search history.

(56) References Cited

U.S. PATENT DOCUMENTS

| | | | | |
|---|---|---|---|---|
| 525,241 | A | 8/1894 | Tucek | |
| 1,926,078 | A | 9/1933 | Yonts | 2/42 |
| 2,055,094 | A | 9/1936 | Zweben | 2/42 |
| 2,089,474 | A * | 8/1937 | Hyman | 2/333 |
| 2,444,806 | A * | 7/1948 | Cleasby | 2/336 |
| 2,782,418 | A | 2/1957 | Garson | 2/42 |
| 2,870,768 | A | 1/1959 | Robinson | 128/510 |
| 3,334,632 | A | 8/1967 | Rashkin | 128/501 |
| 3,411,508 | A | 11/1968 | Sayers | 128/430 |
| 3,502,396 | A * | 3/1970 | Drive et al. | 351/157 |
| 4,414,716 | A * | 11/1983 | Stastney | 24/3.12 |
| 4,612,935 | A | 9/1986 | Greifer | 128/510 |
| 4,795,399 | A * | 1/1989 | Davis | 2/460 |
| 5,024,628 | A | 6/1991 | Sanchez | 450/36 |
| 5,201,078 | A | 4/1993 | Melton | 2/68 |
| 5,441,188 | A | 8/1995 | Rosenstein | 224/264 |
| 5,473,796 | A * | 12/1995 | Fusillo | 24/30.5 R |
| 5,590,545 | A * | 1/1997 | Norris | 24/563 |
| 5,921,845 | A | 7/1999 | Scholtz | 450/86 |
| 5,935,044 | A * | 8/1999 | Brewster | 450/86 |
| 5,964,642 | A * | 10/1999 | Fildan | 450/86 |
| 6,135,853 | A | 10/2000 | Hopson | 450/86 |
| 6,381,752 | B1 | 5/2002 | Cartelli | 2/86 |
| 6,517,409 | B2 | 2/2003 | Flaherty | 450/1 |

FOREIGN PATENT DOCUMENTS

| | | |
|---|---|---|
| CA | 627409 | 9/1961 |
| GB | 1146838 | 6/1966 |
| GB | 2295846 | 6/1996 |

* cited by examiner

*Primary Examiner*—Gloria Hale
(74) *Attorney, Agent, or Firm*—Clifford Kraft

(57) ABSTRACT

A device that can be worn under clothing preferably near the nape of the neck to hold the rear shoulder straps of a bra together a determined distance after the wearer establishes a desired degree of cleavage by first lifting upward on the front bra straps. The device can be rubber, plastic, cloth or other flexible material and can be adjustable to different sizes. The device can include two opposing clips that engage the bra straps holding them together to maintain the desired degree of cleavage. The device can be supplied in one or two pieces and be adjustable.

17 Claims, 8 Drawing Sheets

METHOD AND APPARATUS FOR ENHANCING A BUSTLINE

This is a continuation-in-part of application Ser. No. 11/130,512 filed May 17, 2005 now abandoned and claims priority from that application.

BACKGROUND

1. Field of the Invention

The present invention relates generally to the field of women's beauty enhancement and more particularly to a method and apparatus for enhancing a woman's bust-line by lifting the breasts causing more cleavage to show with a particular bra.

2. Description of the Prior Art

There are numerous brassieres (bras) in the prior art that address different aspects of the function of supporting a bust-line. There is also art that teaches hiding bra straps, matching clothing and various removable or adjustable bra features.

Hopson in U.S. Pat. No. 6,135,853 teaches a device that is used to pull bra straps together to concealing them. Scholtz in U.S. Pat. No. 5,921,845 teaches lower support straps. Robinson in U.S. Pat. No. 2,870,768 teaches a multiple strap bra. Rashkin in U.S. Pat. No. 3,334,632 teaches a torso-encircling garment. Brewster in U.S. Pat. No. 5,935,044 teaches an apparatus for securing bra straps in a particular position. Greifer in U.S. Pat. No. 4,612,935 teaches various comfort accessories for brassieres.

While the prior art teaches various aspects of bra design, what is badly needed is a device that will work with any bra to hold the bra straps together in the back to hold lift of the breasts so that a woman's appearance is enhanced by showing more cleavage (after lifting the breasts from the front straps). This would be very useful for a woman who, after work, wishes to put on an evening blouse that is low cut so that more cleavage can show, but who wishes to use the same or a standard bra, or for a woman who feels her breasts need a lift because of a natural tendency to sag.

SUMMARY OF THE INVENTION

The present invention relates to a method and apparatus to enhance a woman's beauty or attractiveness by holding the straps of a bra together after a wearer has pulled the cups upward from the front causing an increase in cleavage. The apparatus can be a planer or any other type of piece that is worn on the back preferably near the nape of the neck. A hinged or pivoting bar, clip or latch can be used to grip the bra straps and pull them together. The device can be made adjustable to allow for an increase or decrease in the amount of cleavage. The piece in contact with the skin should preferably be soft or covered with a soft material to prevent discomfort. Parts of the device can be made of metal, cloth, supported cloth or any other material that can pull a pair of bra straps together.

Several drawings and illustrations have been presented to aid in the understanding of the present invention. The scope of the present invention is not limited to the figures.

DESCRIPTION OF THE INVENTION

Figure 1:
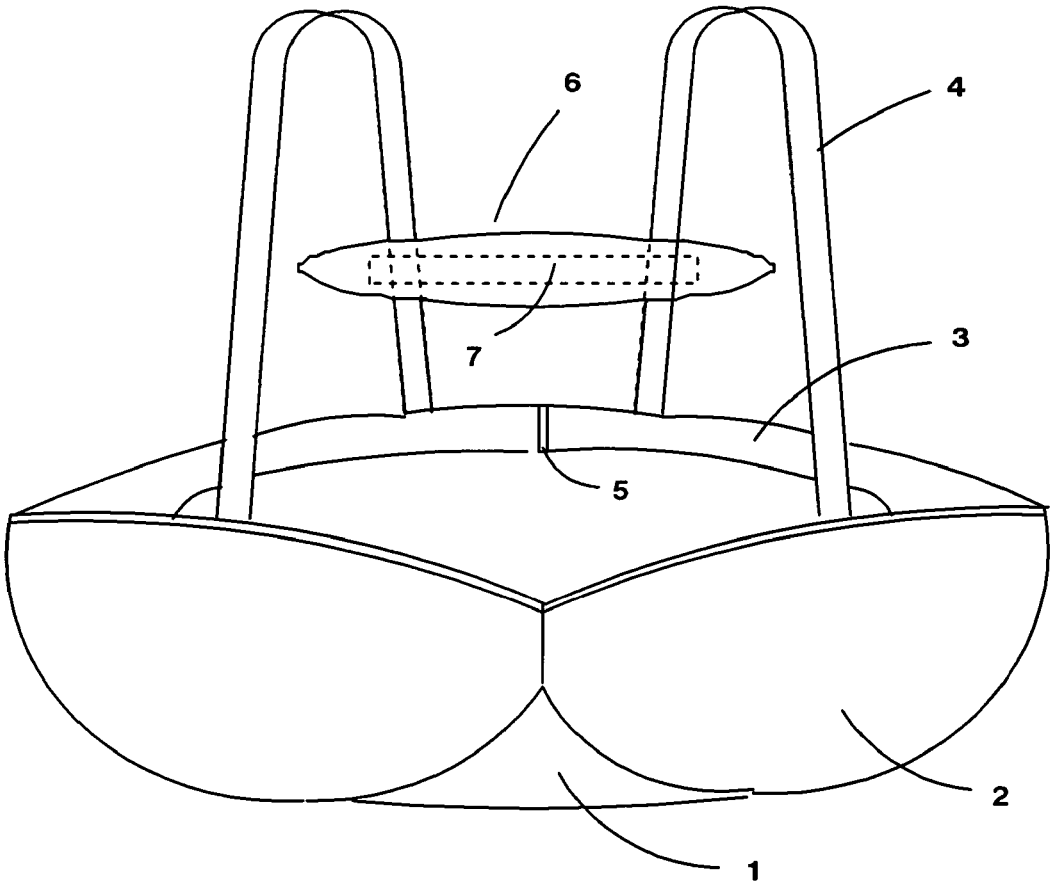
FIG. 1 shows a typical bra with an embodiment of the present invention installed.

Turning to FIG. 1, a typical bra is seen. A bra normally has a front support 1, cups 2, back-straps 3 and shoulder straps 4. The back-straps 3 are normally fastened together in the middle of the back with a clip 5. The present invention includes a type of holder or clip 6 that can pull the shoulder straps 4 together causing the cups 2 to lift the breasts upward increasing cleavage and enhancing a woman's appearance. The holder 6 of the present invention can be equipped with a slide latch 7 or any other means of holding the bra shoulder straps 4 and pulling them together.

Normally, the device of the present invention can be worn near the nape of the neck to effectively hold the bra shoulder straps 4 together to secure the lifting of the cups 2 upward. The wearer normally first lifts the cups to the desired position and then secures the device of the present invention to pull and hold the straps together from the back.

Figure 2A:
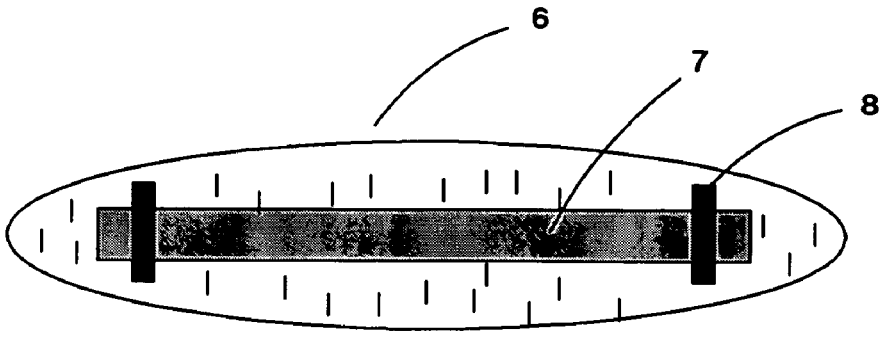
FIGS. 2A and 2B show a fixed embodiment of the present invention.
Figure 2B:
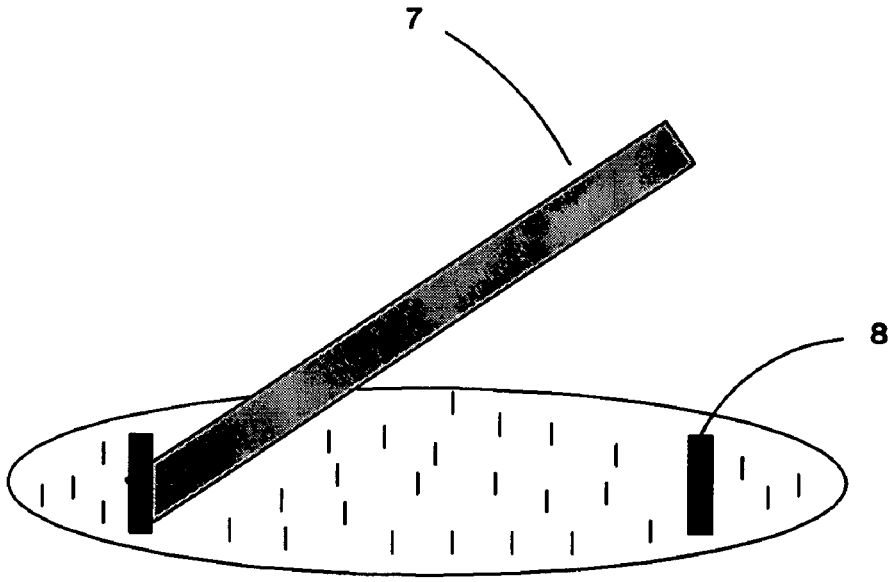

FIGS. 2A and 2B show a fixed embodiment of the present invention where a cloth covered surface 6 is equipped with a pivotable or hinged latch 7 and two locks or clips 8. The bra shoulder straps can be threaded between the pivoting latch 7 and the surface 6.

Figure 3A:
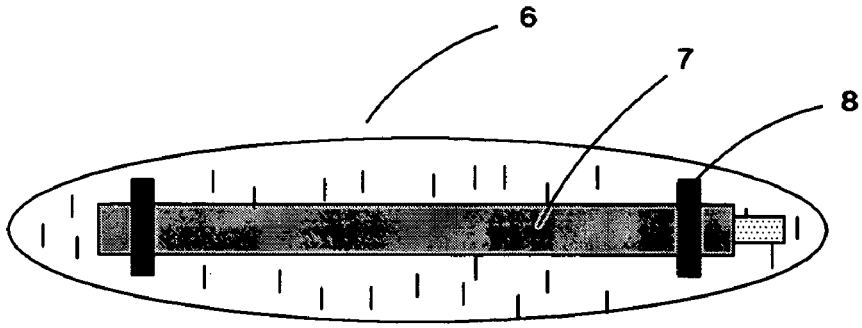
FIGS. 3A and 3B show an adjustable embodiment of the present invention.
Figure 3B:
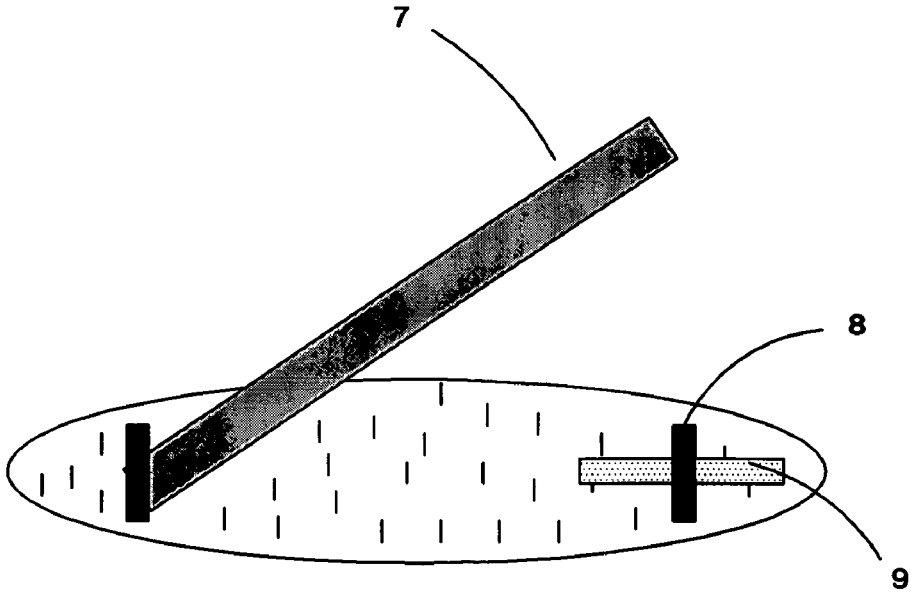

FIGS. 3A and 3B show an adjustable embodiment of the present invention that is similar to that shown in FIGS. 2A and 2B except that an adjustment tab 9 allows for the device to be adjusted to the desired tightness. While the adjustment tab 9 is shown on one end of the surface 6 in FIGS. 3A and 3B, it is within the scope of the present invention to have tabs on both ends or anywhere else, or to have multiple adjustment devices.

Figure 4:
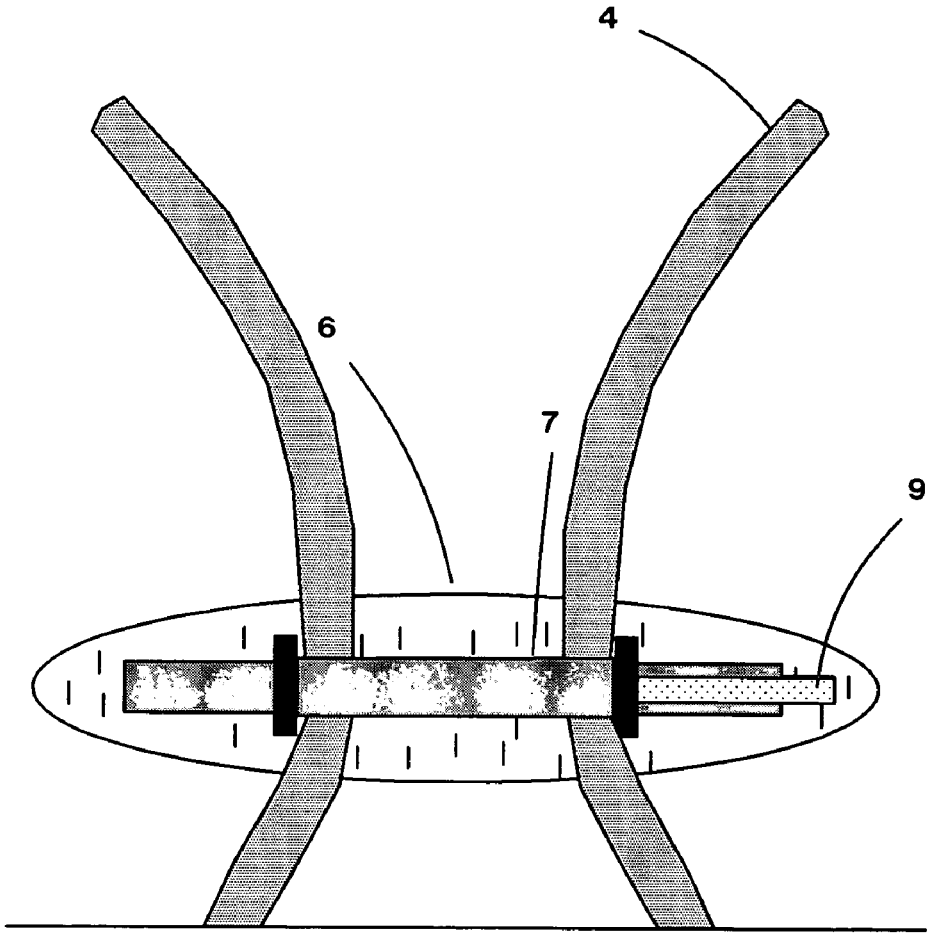
FIG. 4 shows how an embodiment of the present invention can pull bra straps together to enhance cleavage.

FIG. 4 shows an embodiment of the present invention pulling a pair of bra shoulder straps 4 together in order to increase the amount of cleavage. The pivoting latch 7 closes and can normally be locked by clips or other means. An adjustment tab 9 allows the wearer to adjust the device to the desired tightness.

Figure 5A:
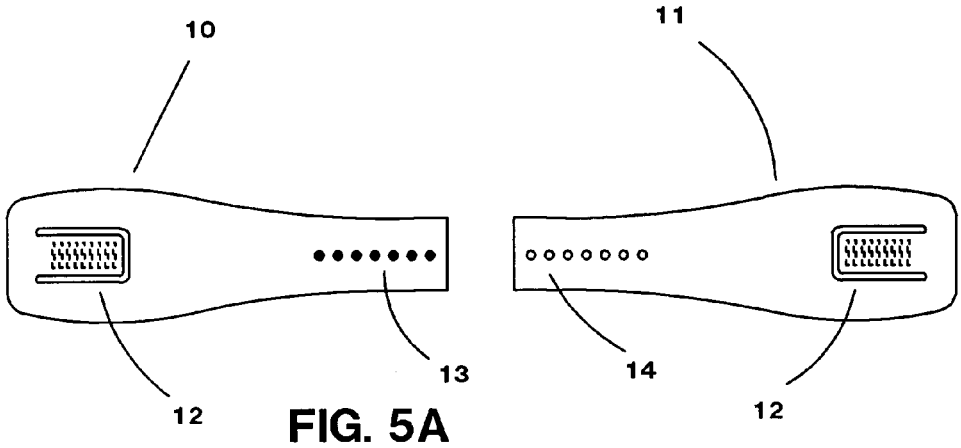
FIGS. 5A-5B show an alternative embodiment of the present invention.
Figure 5B:
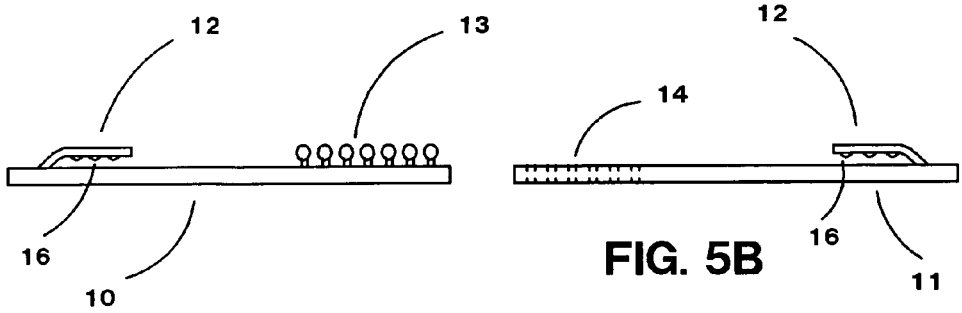
Figure 6:
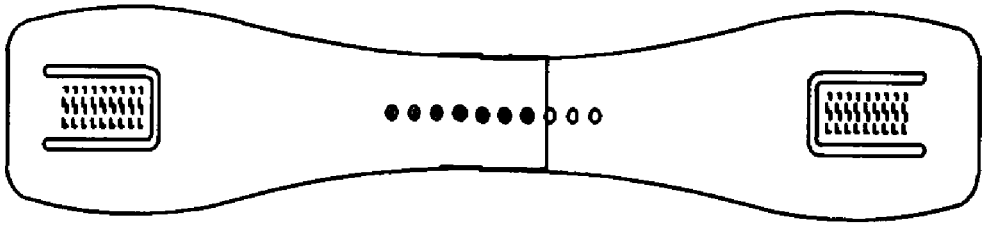
FIG. 6 shows a one-piece version of the embodiment of FIGS. 5A-5B.

FIGS. 5A and 5B show an alternate embodiment of the present invention. This embodiment can be made from a pair of relative flat members 10, 12 that can be coupled together in the center with an adjustable series of small pegs 13 or other devices in one member that fit in mating holes 14 in the second member. While pegs and holes are the preferred method, any fastening means can hold the two parts together. On the outside ends of each member there can be a clip 12 that extends outward and away from the member to clasp a bra strap. Each clip 12 can be a cantilever piece that has a portion that slants away from the member at an acute angle and a portion that runs parallel to the member. Each clip 12 can optionally contain raised areas or grips 16 to better grip the strap. When both clips are engaged in the bra straps, they can hold them together to retain the enhanced cleavage. The exact tightness or size or the apparatus can be adjusted at the user's convenience by simply aligning the pegs 13 and the holes 14 differently. FIG. 6 shows the two members coupled together to make a particular size or length. While it is within the scope of the present invention to make the members from any flexible or semi-flexible material, the preferred materials are rubber, plastic or re-enforced cloth.

Figure 7:
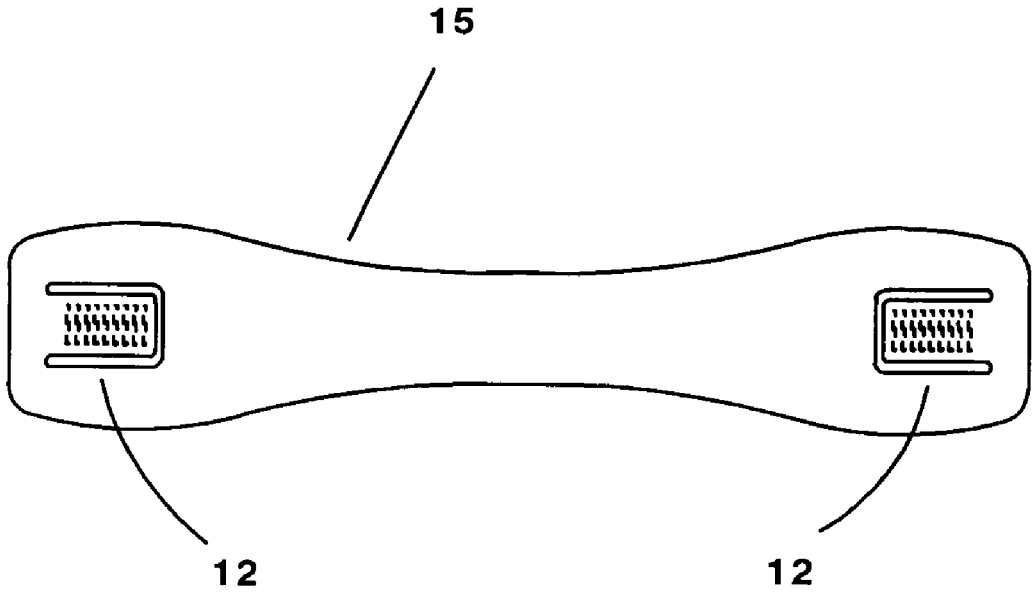
FIG. 7 shows how the embodiment of FIGS. 5A-5B (or FIG. 6) can be used to hold a bra strap.

FIG. 7 shows a one-piece version of the embodiment shown in FIGS. 5A-5B. This version works in a manner similar to the two-piece embodiment of FIGS. 5A-5B; however, it is not adjustable. It can, however, be supplied in different fixed lengths.

Figure 8:
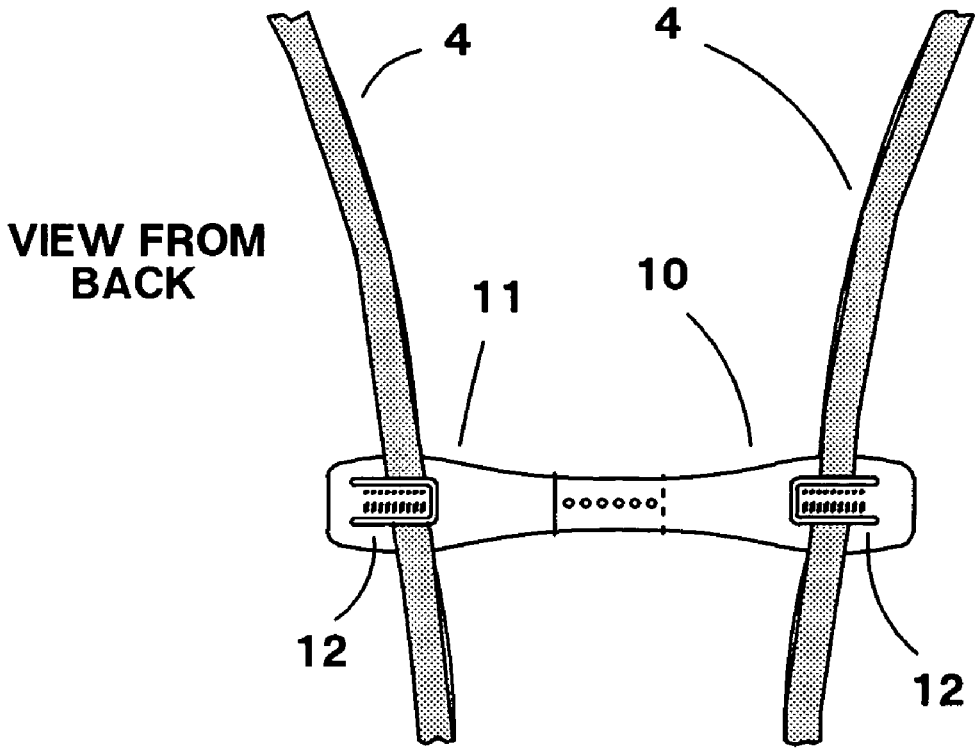
FIG. 8 shows the way of wearing the embodiment of FIGS. 5A-5B.

FIG. 8 shows how the embodiments of FIGS. 5A, 5B and 6 can be used. The clip 12 extending away from the member 10,11 can be used to secure the bra strap 4 on each side holding it together after cleavage is adjusted by pulling up on the front straps. It should be noted that each clip 12 faces outward away from the body rather than inward. This is a very important feature of the present invention. An inward-facing clip can feel very uncomfortable and can even hurt the skin of the user or cause a mark.

It should be noted that the surface of the present invention should be soft to the skin to avoid discomfort to the wearer. This can be accomplished by covering it with cloth or other soft material. Also, the device is generally worn under clothing and should be thin. Finally, the device is usually worn around the nape of the neck to hold maximum uplift to the cups. The surface and clip can be made of any flexible or semi-rigid material including rubber, plastic or metal. The clips, latches and adjustments can be metal or plastic. Rubber or plastic is the preferred material. The optional covering material can be any soft material. A material like velvet is preferred. It is desirable to have a material that can be easily cleaned.

The present invention can advantageously be adjusted to provide a desired amount of cleavage. The amount of cleavage can be adjusted by pulling the straps from the front upwards and then adjusting the height and width of the strap position with the device. Pulling upward from the front first and then securing the straps to hold the desired cleavage is very different from simply pulling the straps together. While simply pulling the straps together may cause the breasts to rise somewhat, it is not possible to achieve or adjust a desired degree of cleavage by simply pulling the straps together in the rear without lifting in the front. Therefore, the method of use is very important for the functioning of the present invention in that the user first pulls the front straps of the bra upward (preferably in front of a mirror) to achieve exactly the desired cleavage and then later clips the rear straps with the apparatus of the present invention to hold that cleavage. The reverse process simply will not work satisfactorily.

Several descriptions and illustrations have been provided to aid in the understanding of the present invention. It will be clear to one skilled in the art that many changes and variations are possible. In particular, any device that holds the straps of a bra together to lift the breasts and enhance cleavage is within the scope of the present invention. All such changes and variations are also within the scope of the present invention.

I claim:

1. An apparatus for enhancing a woman's beauty by maintaining an increase in cleavage after a user first lifts front bra straps upward, the apparatus being used to hold rear bra straps in tighter proximity maintaining said increase, said apparatus comprising:

a pair of semi-rigid flat elongated members, each having a body facing surface and an exterior facing surface with first and second ends, wherein the body facing surface is worn facing the body of the user;

a fastening means for adjustably joining the first end of one of the members to the first end of the other member;

a first clip means proximate the second end of one of said members, and a second clip means proximate the second end of the other of said members, the clip means located on the exterior facing surfaces of said members, said clip means for holding the bra straps in said tighter proximity;

and wherein said first and second clip means comprise a pair of hook segments cooperating with the elongated members to hold the straps, each of said hook segments connected to one of said elongated members and extending outwardly of the exterior facing surface of the elongated member and towards each other in a cantilever manner when said elongated members are joined.

2. The apparatus of claim 1 wherein said body facing surfaces of said members is covered with a soft material to prevent discomfort to the wearer.

3. The apparatus of claim 1 wherein said fastening means is a series of pegs and holes.

4. The apparatus of claim 3 wherein said series of pegs and holes are aligned linearly along a longitudinal axis of said elongated member.

5. The apparatus of claim 1 wherein said apparatus is rubber.

6. The apparatus of claim 1 wherein said apparatus is plastic.

7. The apparatus of claim 1 wherein said clip means are metal.

8. A method for enhancing a woman's appearance by increasing breast cleavage comprising the steps of:

puffing on a bra, said bra having two cups and two straps, each strap having a front part and a rear part;

raising the cups upward by pulling upward on the front part of said straps to lift a wearer's breasts upward to show a desired amount of cleavage;

attaching a device between said rear part of the straps that holds the straps together thereby maintaining said desired amount of cleavage;

wherein said device comprises:

a pair of semi-rigid flat elongated members, each having a body facing surface and an exterior facing surface with first and second ends, wherein the body facing surface is worn facing the body of the user;

a fastening means for adjustably joining the first end of one of the members to the first end of the other member;

a first clip means proximate the second end of one of said members, and a second clip means proximate the second end of the other of said members, the clip means located on the exterior facing surfaces of said members, said clip means for holding the bra straps in said tighter proximity;

and wherein said device is worn near the nape of the neck.

9. The method of claim 8 wherein said clip means comprises a pair of hook segments cooperating with the elongated members to hold the straps, each of said hook segments connected to one of said elongated members and extending outwardly of the exterior facing surface of the elongated member and towards each other in a cantilever manner when said elongated members are joined.

10. The method of claim 8 wherein a portion of said device is covered with soft material to prevent discomfort to a wearer.

11. The method of claim 8 wherein said device is flat so as to not show through said wearer's clothing.

12. A semi-rigid apparatus for enhancing a woman's beauty by maintaining an increase in cleavage, the apparatus being used to engage and hold bra straps in tighter proximity in the rear maintaining said cleavage, the apparatus comprising:

a flat plate-like segment with one face for engaging a person's back and an opposite face for engaging and holding said straps; and a pair of hook segments disposed at opposite ends of the flat segments for cooperating with the flat segment to hold the straps, said hook segments connected to the flat segment and extending outwardly of the opposite face of the flat segment and towards each other in a cantilever manner;

and wherein said plate-like segment comprises two separable portions of approximately equal length attached to each other by a fastening means, said fastening means providing an adjustable attachment of said two separable portions.

13. The apparatus of claim 12 further comprising said hook segments including gripping means for gripping a strap.

14. The apparatus of claim 12 wherein said plate-like segment is rubber.

15. The apparatus of claim 12 wherein said plate-like segment is plastic.

16. The apparatus of claim 12 wherein said fastening means includes a series of pegs on one of said portions and a series of holes on the other of said portions, said pegs mating into said holes.

17. A semi-rigid apparatus for enhancing a woman's beauty by maintaining an increase in cleavage, the apparatus being used to engage and hold bra straps in tighter proximity in the rear maintaining said cleavage, the apparatus comprising:

a flat plate-like segment with one face for engaging a person's back and an opposite face for engaging and holding said straps; and a pair of hook segments disposed at opposite ends of the flat segments for cooperating with the flat segment to hold the straps, said hook segments connected to the flat segment and extending outwardly of the opposite face of the flat segment and towards each other in a cantilever manner;

and wherein said fastening means includes a series of pegs on one of said portions and a series of holes on the other of said portions, said pegs mating into said holes.

* * * * *

UNITED STATES PATENT AND TRADEMARK OFFICE

CERTIFICATE OF CORRECTION

PATENT NO. : 7,410,407 B2
APPLICATION NO. : 11/367062
DATED : August 12, 2008
INVENTOR(S) : Mandy Krammel It is certified that error appears in the above-identified patent and that said Letters Patent is hereby corrected as shown below:

In column 4, line 30, the word "puffing" should be replaced by the word "putting", as shown below:

Claim 8. A method for enhancing a woman's appearance by increasing breast cleavage comprising the steps of: ~~puffing~~ putting on a bra, said bra having two cups and two straps, ...

Signed and Sealed this

Fourth Day of November, 2008

JON W. DUDAS
*Director of the United States Patent and Trademark Office*